United States Patent [19]

Makino

[11] Patent Number: 4,918,971

[45] Date of Patent: Apr. 24, 1990

[54] BENDING TOOL

[76] Inventor: Osamu Makino, 1-15-3, Bubai-cho, Fuchu-shi, Tokyo, Japan

[21] Appl. No.: 322,610

[22] Filed: Mar. 13, 1989

[30] Foreign Application Priority Data

Apr. 22, 1988 [JP] Japan ..... 63-98074

[51] Int. Cl.[5] ..... B21D 5/01

[52] U.S. Cl. ..... 72/389; 72/413; 72/473; 72/481

[58] Field of Search ..... 72/413, 414, 416, 389, 72/384, 385, 472, 473, 474, 475, 482

[56] References Cited

U.S. PATENT DOCUMENTS

| | | | |
|---|---|---|---|
| 2,023,638 | 12/1935 | Lawson | 72/413 |
| 2,847,053 | 8/1958 | Hardman | 72/414 |
| 2,965,148 | 12/1960 | Oeckl | 72/413 |
| 3,495,435 | 2/1970 | Hanni | 72/448 |
| 3,509,757 | 5/1970 | Hanni | 72/414 |
| 4,356,718 | 11/1982 | Makino | 72/413 |

OTHER PUBLICATIONS

Power Brake Dies Inc., "General Purpose and Special Press Brake Tooling", 1974, pp. 8–15.

The Cincinnati Shaper Co., "Cincinnati Mechanical Press Brakes", Dec. 1959, pp. 32–34.

*Primary Examiner*—David Jones

[57] ABSTRACT

Two dies, each having a blade and a bending block with a specified gap therebetween, are disposed in vertical alignment with and in opposing relationship with each other in such a way that the vertical blade center line of one die comes almost at the center between the vertical blade center line of the other die and the end face of the bending block of the latter die facing the blade. Either the blade or the bending block is integrally formed with the die body while the other is securely fixed to the die body by a fastening means.

5 Claims, 3 Drawing Sheets

BENDING TOOL

BACKGROUND OF THE INVENTION

1. Field of the Invention

The present invention relates to a bending tool mounted on a press bending machine (also called a press brake) for bending machanical parts.

2. Description of the Prior Art

Various types of L- or Z-shaped fittings are widely used as brackets and reinforcing members for structures of machines and equipments. These L- or Z-shaped fittings are manufactured by bending tools, and an example of improvement over conventional bending tools may be found in the U.S. Pat. No. 4,356,718 or in FIG. 1. FIG. 1 schematically shows the side view of a bending tool consisting of a pair of an upper die 7 and a lower die 17. The upper die 7 is securely fixed at its base to a body 9 of the press bending machine by means of bolts 10 or other suitable fastening means.

Disposed beneath the upper die 7 is the lower die 17 which is securely fixed to a table 22 of the press bending machine body 9 by screws 23.

The upper die 7 consists of a blade 3 and a bending block 6. The blade 3 has a pointed edge with a bending angle of about 90°, arranged so that a vertical center line of the edge bisects the bending angle. The edge, in cross section, has a longer side 1 on the outside with respect to the vertical center line and a shorter side 2 on the inside. The bending block 6 is laterally or horizontally spaced from the short edge side 2 of the blade 3 with an adjustable gap 5 therebetween, and has a nearly rectangular end face 4 opposing the shorter edge side 2 of the blade 3. The end face 4 of the bending block 6 and the blade 3 define the adjustable gap 5 which is rectangular in cross section, cutting into the upper die perpendicularly from the bottom end surface of the upper die. The bending block 6 is securely mounted to the body of the upper die 7 by screws 21 or other fastening means. Inserted between the bending block 6 and the die body that supports the bending block are a plurality of thin plate-like spacers 20, the number of which is increased or reduced to adjust the size of the gap 5.

The lower die 17 has a similar construction to the upper die 7. That is, the lower die 17 consists of a blade 13 and a bending block 16. The blade 13 has a pointed edge with a bending angle of about 90°, arranged so that a vertical center line of the edge bisects the bending angle. The edge, in cross section, has a longer side 11 on the outside with respect to the vertical center line and a shorter side 12 on the inner side. The bending block 6 is laterally spaced from the shorter edge side 12 of the blade 13 with an adjustable gap 15 therebetween, and has a nearly rectangular end face 14 opposing the shorter edge side 12 of the blade 13. The end face 14 of the bending block 16 and the blade 13 define the adjustable gap 15 which is rectangular in cross section, cutting into the lower die perpendicularly from the top end surface of the lower die. The bending block 16 is securely mounted to the body of the lower die 17 by screws 19 or other fastening means. Inserted between the bending block 16 and the die body that supports the bending block are spacers 19, the number of which is increased or reduced to adjust the size of the gap 15.

The upper die 7 and the lower die 17 are disposed to oppose each other in such a way that the center line of the blade of one die comes almost at the center between the blade center line of the other die and the end face of the bending block of the latter die facing the blade. In this positional relationship, the two dies 7, 17 are mounted to the body 9 of the bending machine and vertically moved toward and away from each other. As a result, the upper and lower dies 7, 17 engage with each other, bending a work 24 placed on the lower die 17 into a Z-shaped section.

Such conventional bending tools for press bending machines, however, have the following drawbacks. Since the gap 5 is formed between the blade 3 and the bending block mount 25, and since the blade and the bending block mount are formed integral with the body of the upper die 7, it is difficult to form corner portions 26, 27 on each side of the gap 5 perfectly rectangular. Particularly when the corner portion 27 is not formed rectangular with precision, the bending block 6 and spacers 20, when mounted on the end surface of the bending block mount 25, will incline, rendering the bending of the work 24 innacurate. The same also applies to the lower die 17. Since the corner portions 29, 30 between the blade 13 and the bending block mount 28 are difficult to form at right angles with accuracy, the bending block 16 and the spacers 18 tend to be mounted tilted.

SUMMARY OF THE INVENTION

A primary object of this invention is to provide a bending tool for a press which can easily be machined.

A second object of the invention is to provide an improved bending tool for a press whose blade is correctly oriented with respect to a work at all times during the process of bending.

A third object of the invention is to provide a bending tool for a press which can easily be maintained by replacing only a chipped or worn part of the tool.

A fourth object of the invention is to provide a bending tool for a press which consists of an upper die and a lower die that are capable of being machined easily, and in which a blade and a bending block—the working members of the tool that bend the work—are correctly oriented vertically.

To achieve the above objectives, the bending tool according to the invention has a construction in which two dies, each having a blade and a bending block with a specified gap therebetween, are disposed in a vertically opposing relationship in such a way that the center line of the blade of one die comes almost at the center between the blade center line of the other die and the end face of the bending block of the latter die facing the blade, and in which one of the blade and the bending block is formed integral with the body of the die and the other is securely fixed to the die body by a fastening means.

Since one of the blade and bending block of the upper and lower dies is integrally formed with the associated die body and the other is removably mounted to the die body, the manufacture of both dies, particularly of the blade and the bending block, can readily be done. That is, a part of the die other than the blade or the bending block integrally formed with the die body is machined into a flat surface, extending from the base of the blade or block to the lateral end of the die when viewed in cross section. The flat surface of the die forms a bottom surface in the case of the upper die or a top surface in the case of the lower die, and is used as a mount on which the detachable blade or block is mounted. This construction, therefore, substantially reduces the manufacture cost of the upper and lower dies.

With this construction, the mounting surface for the detachable blade or block can be formed correctly, improving the accuracy of the tool. Since the blade or the bending block is made detachable, the left or right side of the die when viewed in cross section is open and flat, i.e., there are no projections or recesses in the die which will obstruct a machining tool working on the die, thus improving the machining efficiency. Furthermore, when the blade or block is chipped, it can easily be removed and repaired or replaced, which is advantageous in terms of maintenance.

DESCRIPTION OF THE PREFERRED EMBODIMENTS

Figure 1:
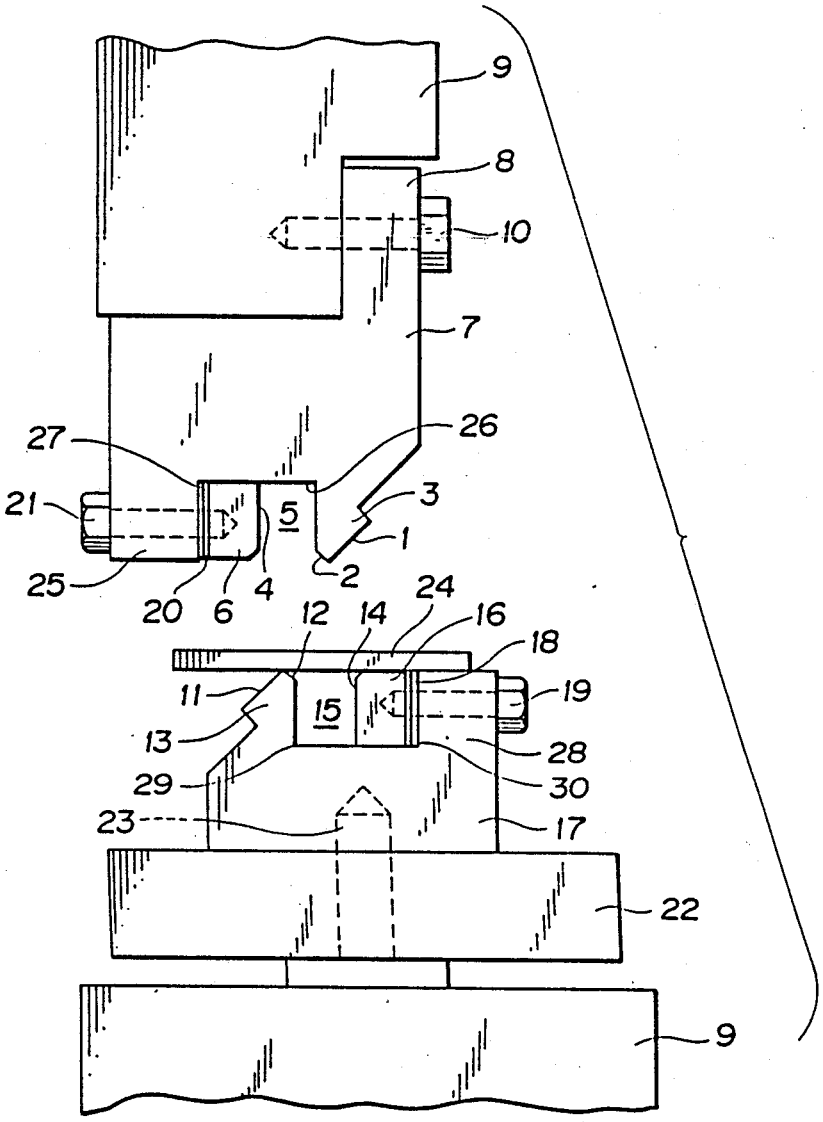
FIG. 1 Prior Art
FIG. 1 is a side view schematically showing a conventional bending tool.
Figure 3:
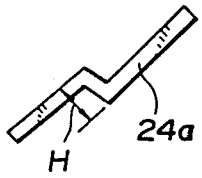
FIG. 3 is a side view showing a work which is bent into a Z-shaped section by the bending tool of the first embodiment.
Figure 2:
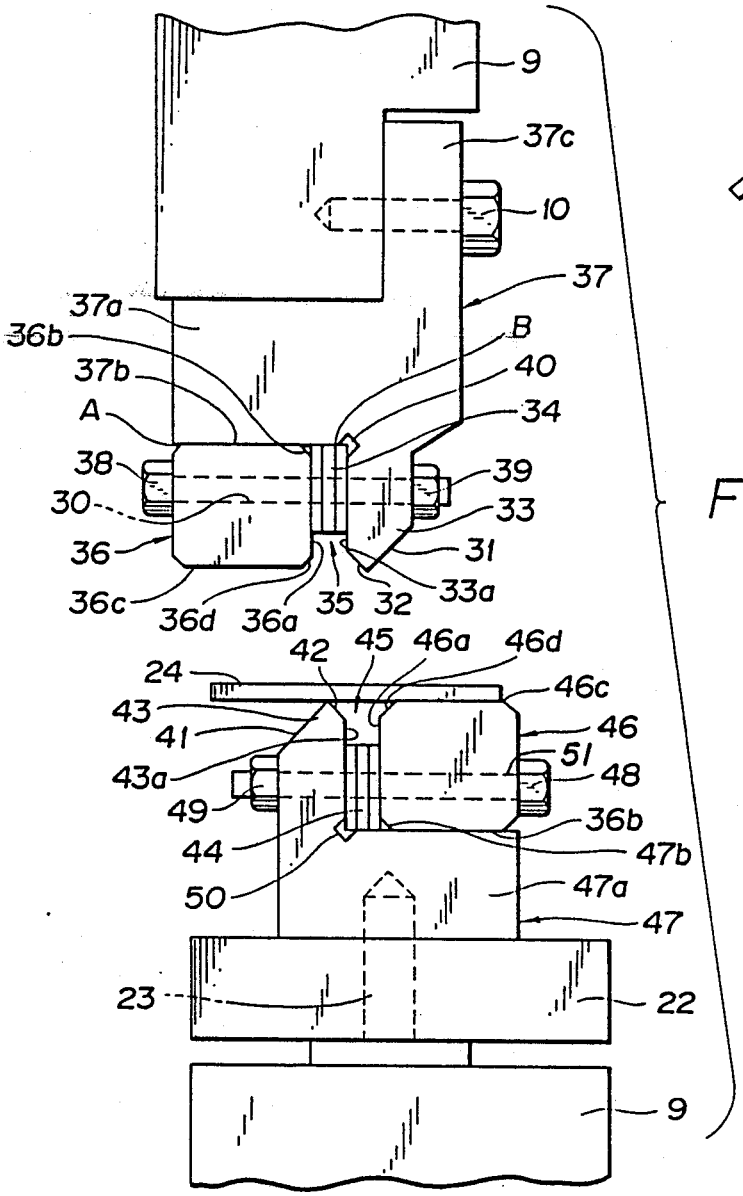
FIG. 2 is a side view schematically showing a bending tool as a first embodiment of the invention.

FIG. 2 and FIG. 3 are side views showing a first embodiment of this invention and a work bent by the tool of the first embodiment, respectively. The bending tool of the first embodiment consists of an upper die 37 and a lower die 47. The upper die 37 has its upper part or mounting portion securely fastened to a bending machine body 9 by bolts 10 or other suitable fastening means. The upper die 37 consists of a die body 37*a* and a blade 33—one of two bending members of the die—which is integrally formed with the die body. The blade 33 has a pointed edge with a bending angle of almost 90°, which when viewed in cross section, is so arranged that the vertical center line of the blade bisects the bending angle. The blade 33, in cross section, also has a longer side 31 on the outside with respect to the vertical blade center line and a shorter side 32 on the inside. The die 37 has a flat bottom surface 37*b* extending horizontally from the base of the blade 33 or point B in FIG. 2 to the lateral end of the die body 37*a* or point A. On the bottom surface 37*b* an escape groove 40 is formed at point B cutting into the die body 37*a*. Also mounted on the bottom surface 37*b* of the die body 37*a* is a bending block 36, another bending member of the die, which is laterally spaced from the blade 33 by a specified distance. The bending block 36 is almost rectangular in cross section and formed of a bar-like member extending in a direction perpendicular to the plane of sheet of FIG. 2. A plurality of spacers 34 are inserted and clamped between the bending block 36 and the blade 33. A horizontal blank hole 30 is formed through the bending block 36, spacers 34 and blade 33 and a bolt 38 is passed through the blank hole 30 with a nut 39 fastened on the end of the bolt shank. With the bolt 38 and nut 39 fastened, the bending block 36 is securely fixed to the blade 33. The height of the spacer 34 is set smaller than that of the bending block 36. The bending block 36 is so dimensioned that the underside 36*c* of the bending block 36, when the block is mounted on the bottom surface 37*b* of the die body 37*a*, is almost flush with the tip of the blade 33. Thus, on the lower side of the spacer 34, there is a gap 35 formed between the inner end face 33*a* of the blade 33 and the inner end face 36*a* of the bending block 36. The lower end corner of the inner end face 36*a* of the bending block 36 is chamfered at an angle of about 45° to form a chamfered face 36*d*.

The lower die 47 also has a construction similar to that of the upper die 37. That is, the lower die 47 consists of a die body 47*a* and a blade 43 formed integral with and projecting upward from one side of the die body 47*a*. The lower die 47 also has a bending block 46 secured to the die body 47*a*, and spacers 44. The blade 43 has a pointed edge with a bending angle of about 90°, which, when viewed in cross section, is so arranged that the vertical center line of the blade bisects the bending angle. The blade 43, in cross section, also has a longer side 41 on the outside with respect to the vertical blade center line and a shorter side 42 on the inside. The die 47 has a flat top surface 47*b* extending horizontally from the base of the blade 43 to the lateral end of the die body 47*a*. At a corner portion where the top surface 47*b* and the inner end face 43*a* of the blade 43 intersect, an escape groove 50 is formed. On the flat top surface 47*b*, the bending block 46 is mounted at a position laterally spaced from the blade 43 by a specified distance. A plurality of spacers 44 are interposed between the bending block 46 and the blade 43. The vertical size of the spacer 44 is set smaller than that of the bending block 46. The upper surface 46*c* of the bending block 46, when the block is mounted on the top surface 47*b* of the die body 47*a*, is almost at the same level as the tip of the blade 43, so that a gap 45 is formed between the inner end face 43*a* of the blade 43 and the inner end face 46*a* of the bending block 46. The bending block 46 has the upper end corner on the inner end face chamfered at an angle of about 45° to form a chamfered portion 46*d*. A horizontal blank hole 51 is formed through the bending block 46, spacers 44 and blade 43. A bolt 48 is passed through the blank hole 51 with a nut 49 fastened on the end of the bolt shank to securely fix the bending block and spacers to the blade 43. The lower die 47 is then mounted on a table 22 on the bending machine body 9 and secured to the table 22 by bolts 23.

The upper die 37 and lower die 47 with the above constructions are arranged in opposition with each other and mounted on the bending machine body 9. The lower die 47 must be adjusted that the blade center line of the upper die 37 comes almost at the center between the blade center line of the lower die 47 and the chamfered portion 46*d* of the bending block 46. As is evident from FIG. 2, the positional relationship between the blade 33 and the bending block 36 of the upper die 37 is symmetrical with that of the blade 43 and the bending block 46 of the lower die 47. This means that centering the blade of one die also puts the blade of the other die in its centered position.

After the upper and lower dies 37, 47 are positioned in this way, a work 24 (generally a metal plate) is placed on the lower die for pressing. The blade 33 of the upper die 37 bends the work 24 at right angles while pushing the engaged portion of the work 24 into the gap 45 adjacent to the blade 43 of the lower die 47. The upper die 37 is stopped by the support action of the longer side 31 of the blade 33 and the chamfered portion 36*d* of the bending block 36. Similarly, the blade 43 of the lower die 47 bends the work 24 at right angles while pushing the engaged portion of the work 24 into the gap 35 adjacent to the blade 33 of the upper die 37. The lower die 47 is then stopped by the support action of the longer side 41 of the blade 43 and the chamfered portion 46*d* of the bending block 46. In this way, a Z-shaped fitting 24*a* as shown in FIG. 3 is formed. The size of a step in the Z-shaped fitting 24*a* (as indicated by H in FIG. 3) can be changed to a desired value by adjusting the distance between the blade 33, 43 and the bending block 36, 46 of the dies 37, 47. That is, by changing the number of spacers 34 in the upper die 37 the bending block 36 can be moved toward or away from the blade 33 to change the size of the gap 35 formed between the blade 33 and the bending block 36. When all the spacers 34 are removed, the shorter side 32 of the blade 33 and the chamfered portion 36*d* of the bending block 36 are directly opposed with each other with no gap therebetween, thus providing the minimum size of the step of the Z-shaped fitting.

Similarly, in the lower die 47, the number of spacers 44 is increased or reduced to move the bending block 46 toward or away from the blade 43. As a result the size of the gap 45 formed between the blade 43 and the bending block 46 is changed, allowing the Z-shaped fittings 24*a* to be formed in various sizes of steps.

During the process of bending the work 24, the relative position of the blade and the bending block will not be disturbed by impacts of bending as the bending blocks 36, 46 are firmly secured to the blades 33, 43 or the die bodies 37*a*, 47*a* by bolts 38, 48 and nuts 39, 49.

Figure 4:
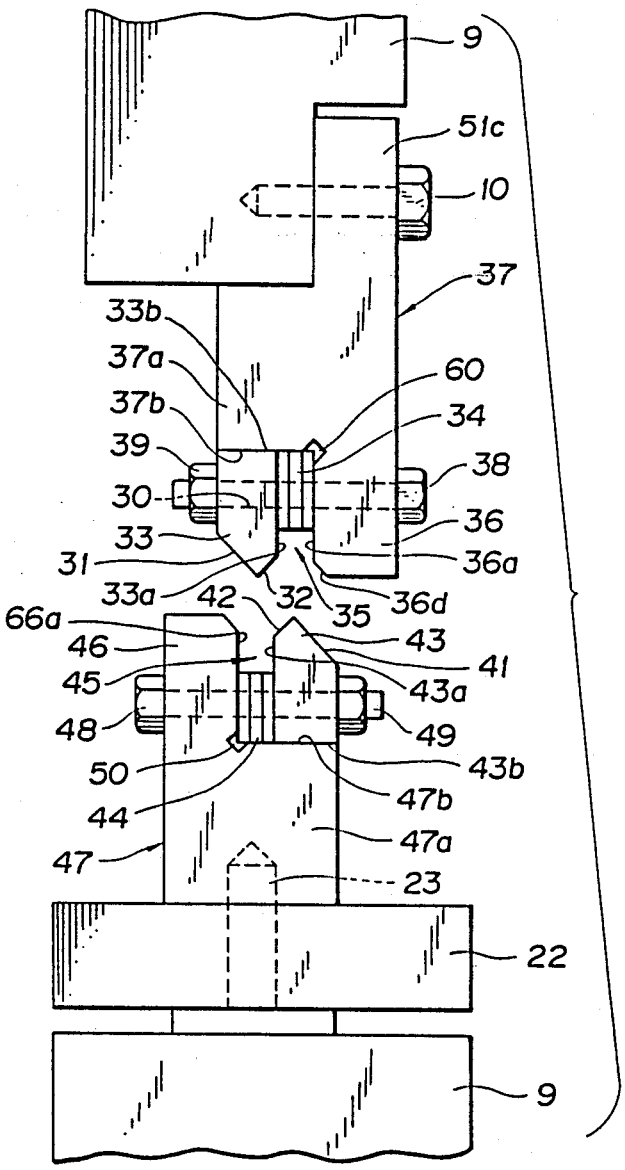
FIG. 4 is a side view schematically showing a bending tool as a second embodiment of the invention.

FIG. 4 shows a second embodiment of this invention. This embodiment differs from the first embodiment in that bending blocks 36, 46 of the upper and lower dies are integrally formed with die bodies 37*a*, 47*a* and that blades 33, 43 are removably mounted to the die bodies 37*a*, 47*a*. In the upper die 37, the bending block 36 is formed integral with the die body 37*a* at the right-hand side lower end portion of the die, as shown in FIG. 4. A flat bottom surface 37*b* is formed on the upper die 37, extending horizontally from the base of the bending block 36 to the left end of the die body 37*a*. A blade 33 formed as a removable block is mounted on the flat bottom surface 37*b*, and a plurality of spacers 34 are inserted between the blade 33 and the bending block 36. As with the first embodiment, a bolt 38 is passed through a blank hole 30 formed through the blade 33, spacers 34 and bending block 36, and a nut 39 is fastened on the end of the bolt shank to rigidly fix the blade 33 to the die body 37*a*.

Likewise, in the lower die 47 a bending block 46 is formed integral with the die body 47*a* at the left-hand side upper end portion of the die, as shown in FIG. 4. A flat top surface 47*b* is formed on the lower die 47, extending horizontally from the base of the bending block 46 to the right end of the die body 47*a*. A blade 43 formed as a removable block is mounted on the flat top surface 47*b*, and a plurality of spacers 44 are inserted between the blade 43 and the bending block 46. A bolt 48 is inserted through a blank hole passing through the bending block 46, spacers 44 and blade 43, and a nut 49 is fastened on the end of the bolt shank to rigidly fix the blade 43 to the die body 47*a*. Other constructions are the same as those of the first embodiment and further explanation will not be made. Parts identical with those of the first embodiment are given like reference numbers.

Although, in the first embodiment, both the upper and lower dies 37, 47 have the blades 33, 43 formed integral with the die bodies 37*a*, 47*a* and the bending blocks 36, 46 removably mounted to the die bodies 37*a*, 47*a*, the invention is not limited to this construction. For example, the upper die 37 may have the bending block detachable as with the first embodiment, while in the lower die 47 the blade 43 may be made detachable and the bending block 46 formed integral with the die body 47*a*. Likewise, in the second embodiment one of the dies, the upper die 37 or the lower die 47, may have the bending block 36 or 46 formed integral with the die body 37*a* or 47*a* while the other die may have an opposite structure in which the blade is formed integral with the die body.

To summarize, in a bending tool for a bending press in which the upper and lower dies, each having a blade and a bending block with an adjustable gap therebetween, are disposed in vertical alignment with and in opposing relationship with each other, this invention is characterized in that one of the bending members of the tool, i.e., the blade or the bending block, is integrally formed with the blade body and the other member is removably mounted to the blade body, thereby enhancing the maintainability of the tool.

Although the invention has been described in conjunction with the preferred embodiments, it will be understood that a person skilled in the art can make various modifications without departing from the spirit and scope of the invention.

What is claimed is:

1. A bending tool for a bending press, comprising:

a first die having a first die body, and a blade provided at one end of said first die body as one bending member, said blade having a pointed edge with a bending angle of about 90° , said pointed edge disposed so that the bending angle is bisected by a vertical center line of said blade, the blade in cross section having a longer side on an outside thereof and a shorter side on an inside thereof, a first bending block disposed in relation to said first die body at a position laterally spaced from the shorter side of said blade as another bending member, said first bending block having a rectangular end face opposing the shorter side of said blade, and a first gap having a predetermined depth and an adjustable width between the blade and the first bending block;

a second die having a second die body, and a blade provided at one end of said second die body as one bending member, said blade having a pointed edge with a bending angle of about 90°, said pointed edge is disposed so that the bending angle is bisected by a vertical center line of said blade, said blade in cross section having a longer side on an outside thereof and a shorter side of an inside thereof, a second bending block disposed in relation to said second die body at a position laterally spaced from the shorter side of said blade as another bending member, said second bending block having a rectangular end face opposing the shorter side of said blade, and a second gap having a predetermined depth and an adjustable width disposed between the blade and the second bending block;

spacers inserted between the blades and the bending blocks in each of the first and second dies; wherein, said first and second dies are disposed in moveable opposition to each other in a manner such that a perpendicular bisector extending through an apex of a bending edge of the blade of the first die passes substantially to a center of said second gap, while a perpendicular bisector extending through an apex of the bending edge of the blade of the second die passes substantially to a center of said first gap, wherein, in at least one of said first and second dies, either a bending member of a blade or a bending block is formed integral with the die body and the other bending member is removably mounted of the die body by fastening means, said die body having a flat surface extending horizontally from a base of the bending member integrally formed with the die body to a lateral end of the die body, and further, a base end surface of the bending member removably mounted on the die body is engaged with said horizontally extending flat surface.

2. A bending tool for a bending press as set forth in claim 1, wherein the bending member formed integral with the die body is a blade and the other bending member removably mounted to the die body is a bending block.

3. A bending tool for a bending press as set forth in claim 2, wherein the bending member formed integral with the die body is a bending block and the other bending member removably mounted to the die body is a blade.

4. A bending tool for a bending press as set forth in claim 3, wherein the spacers are formed of a plurality of plate members and heights of the spacers are set smaller than heights of the blade and the bending block to form a gap on a free end side of the spacers which extends between said blade and said bending block.

5. A bending tool for a bending press as set forth in claim 4, wherein a blank hole is formed through the blade, the bending block and the spacers, a screw member is passed through the blank hole and a nut is fastened on an end of a screw shank to rigidly secure said removable bending member and said spacer to the die body.

* * * * *